United States Patent [19]

Moser

[11] 4,079,228

[45] Mar. 14, 1978

[54] PRESSURIZED SOLVENT FUSING

[75] Inventor: Rabin Moser, Fairport, N.Y.

[73] Assignee: Xerox Corporation, Stamford, Conn.

[21] Appl. No.: 737,469

[22] Filed: Nov. 1, 1976

[51] Int. Cl.[2] ..... H05B 1/00; G03G 15/20

[52] U.S. Cl. ..... 219/216; 219/388; 432/60

[58] Field of Search ..... 219/216, 388; 355/3 FU, 355/10; 354/300; 432/60, 228

[56] References Cited

U.S. PATENT DOCUMENTS

| | | | |
|---|---|---|---|
| 3,704,524 | 12/1972 | Kamola et al. | 354/300 X |
| 3,883,291 | 5/1975 | Cloutier et al. | 432/60 |

*Primary Examiner*—C. L. Albritton

[57] ABSTRACT

A toner image fusing apparatus for utilization in a xerographic reproducing machine which apparatus utilizes the combination of a solvent for the toner together with heat and pressure provided by a pair of roll members which form a nip therebetween through which the copy substrates having the toner images thereon are passed with the toner images contacting the heated roll of the roll pair. Prior to passage of the substrate through the nip formed by the aforementioned rolls, the toner images are moved through a saturated environment of solvent for the toner, the saturated environment and the pair of rollers being disposed in a substantially enclosed housing.

12 Claims, 2 Drawing Figures

PRESSURIZED SOLVENT FUSING

BACKGROUND OF THE INVENTION

This invention relates generally to xerographic reproducing apparatus and more particularly, to a toner fusing apparatus therefor.

In the process of xerography, a light image of an original to be copied is to be recorded in the form of a latent electrostatic image upon a photosensitive member with subsequent rendering of the latent image visible by the application of electroscopic marking particles, commonly referred to as toner. The visual image can be affixed directly upon the photosensitive member of transferred from the member to a sheet of plain paper or other suitable copy substrate with subsequent fixing of the image thereto.

In order to permanently affix or fuse electroscopic toner material onto a support member, it is necessary to treat the toner material, for example, by the application of heat or a solvent for the toner material which causes the constituents of the toner material to coalesce and become tacky. Stated differently, the application of heat or solvent must increase the flowability of the toner material whereby it is absorbed to some extent into the fibers of the support member which, in many instances, constitute plain paper. Thereafter, as the toner material cools or the solvent vapors are driven off, solidification of the toner material occurs causing the toner material to be firmly bonded to support member.

The most common method of fusing toner images employs the combination of heat and pressure. However, the power requirements for such systems are so great that they do not lend themselves to long life and energy conservation which directly bear on the overall costs of the fuser sub-assembly.

In a pure solvent fusing apparatus utilized in the higher speed machines, the quantity of solvent required to effect fusing of toner images is sufficiently high so as to present problems of toxicity and economical solidification of toner images within a reasonable time frame.

It has been demonstrated by various persons working in the xerographic arts that toner images can be fused by exposing the images to solvent vapors or liquid solvents, the ratio by weight of solvent to toner for fusing to take place being at least equal to 0.20 and not greater than 1.0 at room temperature. The ratio is determinative of the speed at which fusing takes place (i. e. the higher the ratio the faster the fusing at any given vapor pressure of the solvent).

It will be appreciated by those skilled in the art that it is desirable to fuse toner images using as little solvent (i. e. minimizing toxicity and cost problems) as possible and as fast (i. e. meeting consumer needs or requirements) as possible. One method of accelerating the fusing rate for a predetermined solvent to toner ratio would be to reduce the paper temperature relative to the temperature of the solvent thereby increasing the rate of fusing by increasing the rate of condensation of solvent vapor. However, it is believed that this mode of accelerating fusing has adverse effects on the copy background and it is not considered an acceptable technique for such purposes.

The solubility of known solvents in typical (i. e. 41% and - butylmethracalate and approximately 59% polystyrene or a combination of polyethylene and carbon black) toners is such that at room temperature fusing is very slow and at 30° to 40° F. fusing does not take place at all. The foregoing is believed to be due to insufficient amounts of solvent which toner will absorb at these temperatures. Accordingly, increasing the temperature of the toner and solvent simultaneously accelerates fusing but such acceleration is limited by the boiling point of the solvent and rapidly decelerates at higher temperatures by reducing the partial pressure of the solvent.

Accordingly, it is a primary object of this invention to provide a new and improved fuser for use in electrostatographic copying apparatus.

It is a more particular object of this invention to provide an improved fuser for fixing toner images to copy substrates which fuser utilizes a solvent for the toner.

Another object of this invention is to provide a solvent fuser which permits faster fixing at relatively low solvent to toner ratios.

Still another object of this invention is to provide a solvent vapor fuser which effects faster fusing of toner images at a predetermined solvent to toner ratio.

BRIEF SUMMARY OF THE INVENTION

Briefly, the above-cited objects are accomplished by the provision of a fuser apparatus comprising a substantially enclosed housing containing a source of solvent for toner forming images on copy substrates in combination with a pair of rolls one of which is heated which heated roll cooperate to form a nip through which the copy substrate pass after they have been exposed to a solvent saturated environment.

Means are provided for maintaining a temperature differential between the toner image material and the solvent to be applied to the images to thereby enhance condensation of solvent vapors onto the images. The unfused images are then pressurized and heated above the vapor pressure of the solvent, in the solvent toner combination, such heating and pressurizing being effected by the aforementioned pair of rolls.

It has been found that the application of heat and pressure in the manner disclosed herein softens the toner thereby enhancing flowability therefore increasing the rate of fusing compared to the rate at which fusing would take place if no heat and pressure were available.

Other objects and advantages of the present invention will become apparent when read in conjunction with the accompanying drawings wherein:

FIG. 1 is a schematic representation of a xerographic reproducing apparatus incorporating the novel fuser of this invention; and FIG. 2 is a schematic plan view of a combination solvent, heat and pressure fusing apparatus representing the present invention.

DETAILED DESCRIPTION OF THE PREFERRED EMBODIMENT

Figure 1:
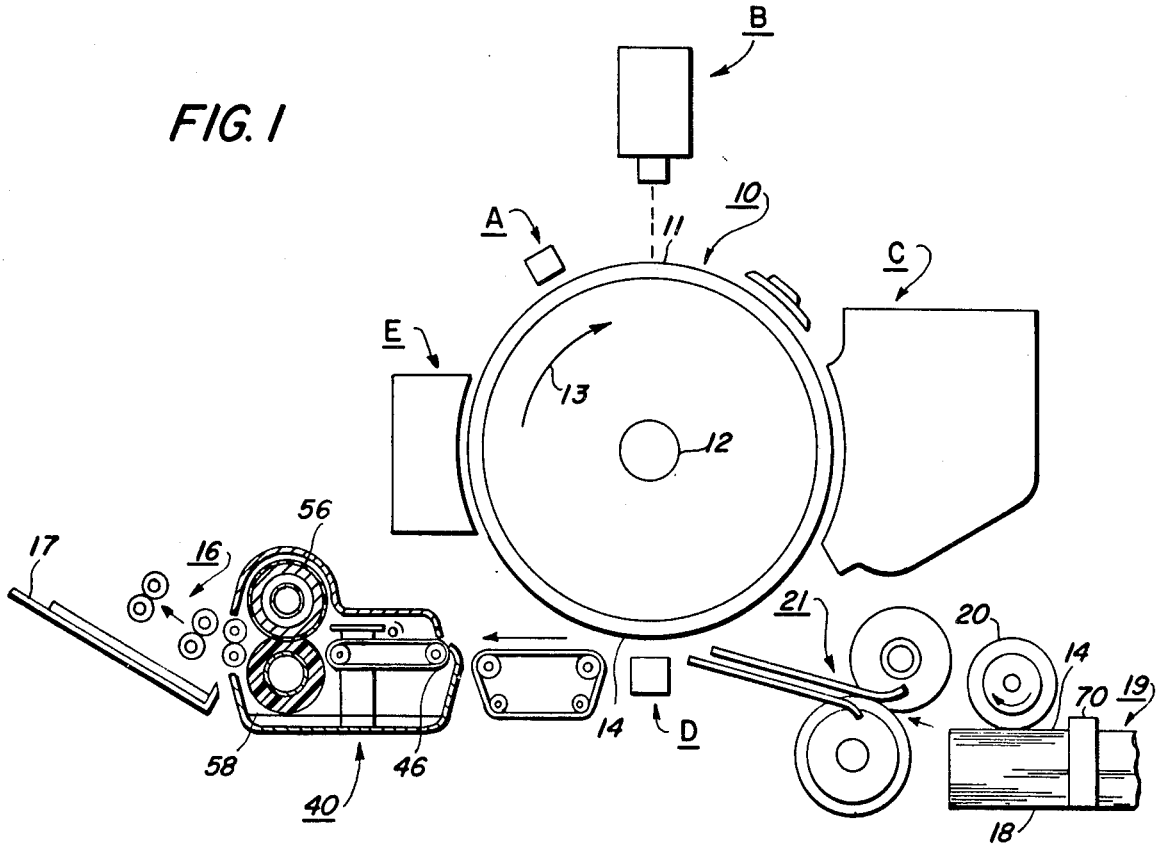

The reproducing machine illustrated in FIG. 1 employs an image recording drum-like member 10 the outer periphery of which is coated with a suitable photoconductive material 11. One type of photoconductive material is disclosed in U.S. Pat. No. 2,970,906 issued to Bixby in 1961. The drum 10 is suitably journaled for rotation within a machine frame (not shown) by means of a shaft 12 and rotates in the direction indicated by arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are herein represented in FIG. 1 as blocks A to F. Initially, the drum moves photoconductive surface 11 through a charging station A. At charging station A an electrostatic charge is placed uniformly over the photoconductive surface 11 of the drum 10 preparatory to imaging. The charging may be provided by a corona generating device of a type described in U.S. Pat. No. 2,836,725 issued to Vyverberg in 1958.

Thereafter, the drum 10 is rotated to exposure station B where the charged photoconductive surface 11 is exposed to a light image of the original input scene information, whereby the charge is selectively dissipated in the light exposed regions to record the original input scene in the form of a latent electrostatic image. A suitable exposure system may be of the type described in U.S. patent application, Ser. No. 259,181 filed June 2, 1974.

After exposure, drum 10 rotates the electrostatic latent image recorded on the photoconductive surface 11 to development station C, wherein a conventional developer mix is applied to the photoconductive surface 11 of the drum 10 rendering the latent image visible. A suitable development station is disclosed in U.S. patent application Ser. No. 199,481 filed Nov. 17, 1971. This application describes a magnetic brush development system utilizing a magnetizable developer mix having carrier granules and toner comprising electrophotographic resin plus colorant from dyes or pigments. A developer mix is continually brought through a directional flux field to form a brush thereof. The electrostatic latent image recorded on photoconductive surface 11 is developed by bringing the brush of developer mix into contact therewith. The developed image on the photoconductive surface 11 is then brought into contact with a sheet of final support material or copy substrate 14 within a transfer station D and the toner image is transferred from the photoconductive surface 11 to the contacting side of the final support sheet 14. The final support material may be plain paper, gummed labels, transparencies such as Polycarbonate, Polysulfane and Mylar, etc., as desired.

After the toner image has been transferred to the sheet of final support material 14, the sheet with the image thereon is advanced to a suitable fuser assembly 15 which fuses the transferred powder image thereto. After the fusing process, the final support material 14 is advanced by a series of rolls 16 to a copy paper tray 17 for subsequent removal therefrom by a machine operator.

Although a preponderance of the toner powder is transferred to the final support material 14, invariably some residual toner remains on the photoconductive surface 11 after the transfer of the toner powder image to the final support material 14. The residual toner particles remaining on the photoconductive surface 11 after the transfer operation are removed from the drum 10 as it moves through cleaning station E. Here the residual toner particles are first brought under the influence of a cleaning corona generating device (not shown) adapted to neutralize the electrostatic charge remaining on the toner particles. The neutralized toner particles are then mechanically cleaned from the photoconductive surface 11 by conventional means as for example, the use of a resiliently biased knife blade as set forth in U.S. Pat. No. 3,660,863 issued to Gerbasi in 1974.

The sheets of final support material 14 processed in the automatic xerographic reproducing device may be stored in the machine within a removable paper cassette 18. A suitable paper cassette is set forth in U.S. patent application Ser. No. 208,138 filed Dec. 15, 1971.

The copier can also have the capability of accepting and processing copying sheets of varying lengths. The length of the copy sheet, of course, being dictated by the size of the original input scene information recorded on the photoconductive surface 11. To this end, the paper cassette 18 is preferably provided with an adjustable feature whereby sheets of varying length and width can be conveniently accommodated therein.

In operation, the cassette 18 is filled with the stack of final support material 19 of pre-selected size and the cassette 18 is inserted into the machine by sliding along a baseplate (not shown) which guides the cassette 18 into operable relationship with a pair of feed rollers 20. When properly positioned in communication with the feed rollers 20 the top sheet of the stack 19 is separated and forwarded from the stack 19 into the transfer station D by means of registration rollers 21.

It is believed that the foregoing description is sufficient for purposes of present application to illustrate the general operation of an automatic xerographic copier which can embody the teachings of the present invention.

Figure 2:
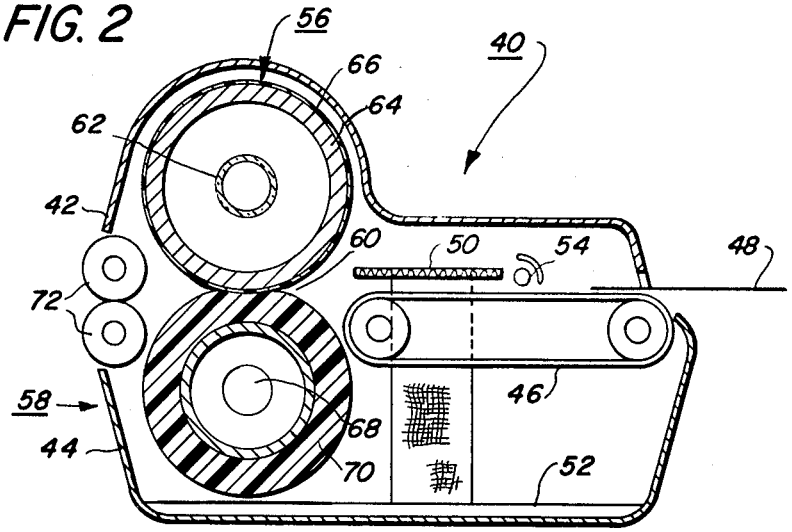

As viewed in FIG. 2, the fusing apparatus 15 comprises a housing 40 having upper and lower portions 42 and 44, respectively. An input transport belt 46 is operatively supported adjacent an elongated inlet 48 of the housing to transport substrates to which toner images have been transferred.

A source of solvent material capable of providing a solvent saturated environment proximate the belt carrying the copy substrates comprises a wick structure 50 fabricated from a material suitable for conveying solvent material 52 such as Freon 113 from the lower housing portion 44 to the end of the wick disposed adjacent the belt 46. The opposite end of the wick is immersed in the solvent 52 for such purposes. A source of radiant energy 54 is provided for maintaining the temperature of the solvent vapors proximate the copy substrate at a temperature of approximately 20° above that of the toner images for the paper thereby enhancing condensation of solvent vapors.

A roll structure 56 supported in the housing 40 cooperates with a backup roll 58 to form a nip 60 through which the copy substrate 14 passes with the toner images contacting the roll 56. In order to elevate the temperature of the toner images lamp 62 is disposed internally of the roll 56 and is operative to elevate the surface temperature of the roll to approximately 180° F or any other suitable operating temperature. The roll 56 comprises a rigid core 64 having a layer 66 of silicone rubber or the like material affixed thereto. The backup roll 58 also comprises a rigid core 68 with a layer of silicone rubber 70, much thicker and therefore more resilient than the layer 66, affixed thereto. The outer layer 70 may have a relatively thin layer of polytetrafluoroethylene applied thereto if desired to meet the requirements of a particular application.

A pair of exit rolls 72 are provided through which the substrate passes in order to exit from the housing 40. At the exit therefor, at the rolls 72 a quantity of solvent will flash out the copy and condense within the housing and therefore be available for re-use. At reduced temperatures such as 180° F. the solvent will be undetectable for various reasons. Accordingly, it will be present only in the toner where it is trapped.

While the invention has been described in conjunction with the preferred embodiment, it will be appreciated that various modifications without departing from the spirit and scope of the invention are possible and it is intended that such modifications be covered in the claims appended hereto.

What is claimed is:

1. Apparatus including a housing having an inlet and an outlet for fusing toner images to copy substrates, said apparatus comprising:

means proximate said inlet for applying a quantity of solvent for said toner to said substrates; and means disposed closer to said outlet than said last-mentioned means for applying heat and pressure to said substrates subsequent to the application of said solvent, the combination of solvent, heat and pressure being sufficient to render said toner images tacky and cause them to adhere to said substrates.

2. Apparatus according to claim 1 wherein said means are operatively supported in a housing adapted to minimize escape of solvent therefrom.

3. Apparatus according to claim 2 including means to maintain a temperature differential between said copy substrate and said means for applying solvent thereto whereby solvent readily condenses on the substrates.

4. Apparatus according to claim 3 wherein said solvent applying means comprises a wick one end of which is supported sufficiently close but out of contact from said copy substrates to provide a solvent saturated environment in the vicinity of the substrates.

5. Apparatus according to claim 4 wherein said housing comprises a sump portion containing solvent and wherein the other end of said wick is immersed in solvent contained in the sump whereby solvent is conveyed from said sump to said one end.

6. Apparatus according to claim 1 wherein said heat and pressure applying means comprises a pair of roll members at least one of which is heated and cooperates with the other to form a nip through which said copy substrates pass with said toner images contacting said at least one of said roll members.

7. Apparatus according to claim 5 wherein said heat and pressure applying means comprises a pair of roll members said at least one of which is heated and cooperates with the other to form a nip through which said copy substrates pass with said toner images contacting said at least one of said roll members.

8. Apparatus according to claim 6 wherein said at least one roll member comprises a rigid core having a layer of silicone rubber affixed to the outer surface thereof.

9. Apparatus according to claim 7 wherein said at leat one roll member comprises a rigid core having a layer of silicone rubber affixed to the outer surface thereof.

10. Apparatus according to claim 4 including belt transport means for transporting said substrate past said one end of said wick and through the solvent saturated environment created thereby.

11. Apparatus according to claim 3 wherein said means for applying heat and pressure has an operating temperature substantially higher than the temperature of said substrates and the ambient temperature in said housing.

12. Apparatus according to claim 11 where said operating temperature is approximately 180° F. and said temperature differential is approximately 20° F.

* * * * *